US006352121B1

(12) United States Patent
Pitell et al.

(10) Patent No.: US 6,352,121 B1
(45) Date of Patent: Mar. 5, 2002

(54) VEHICLE FIRE EXTINGUISHER SYSTEM

(76) Inventors: Mark P. Pitell; Linda L. Pitell, both of P.O. Box 937, Lake Elsinore, CA (US) 92530

( * ) Notice: Subject to any disclaimer, the term of this patent is extended or adjusted under 35 U.S.C. 154(b) by 0 days.

(21) Appl. No.: 09/663,171

(22) Filed: Sep. 15, 2000

(51) Int. Cl.[7] ..... A62C 3/07

(52) U.S. Cl. ..... 169/62; 169/56; 169/13; 169/27

(58) Field of Search ..... 169/62, 61, 60, 169/56, 13, 27

(56) References Cited

U.S. PATENT DOCUMENTS

| | | | | | |
|---|---|---|---|---|---|
| 3,876,011 | A | | 4/1975 | Poitras | |
| 4,262,749 | A | | 4/1981 | Monte | |
| 4,383,579 | A | | 5/1983 | Monk | |
| 4,531,588 | A | * | 7/1985 | Brunsicke | 169/9 |
| 4,566,542 | A | * | 1/1986 | Enk et al. | 169/62 |
| 4,633,967 | A | | 1/1987 | Kranz | |
| D372,560 | S | | 8/1996 | Matigian | |
| 5,613,564 | A | * | 3/1997 | Rhines | 169/61 |
| 5,762,145 | A | | 6/1998 | Bennett | |
| 5,908,074 | A | * | 6/1999 | Potts | 169/62 |
| 5,918,681 | A | * | 7/1999 | Thomas | 169/62 |
| 5,934,379 | A | * | 8/1999 | Ostlyngen et al. | 169/62 |
| 5,941,315 | A | * | 8/1999 | Lai et al. | 169/62 |

* cited by examiner

*Primary Examiner*—David A. Scherbel
*Assistant Examiner*—Dinh Q. Nguyen

(57) ABSTRACT

A vehicle fire extinguisher system for extinguishing a fire in event of a crash or another adverse vehicle mishap. The vehicle fire extinguisher system includes a central processing unit being adapted to be securely mounted in a vehicle including airplanes; and also includes a plurality of heat and impact sensors adapted to be disposed about a vehicle and being connected to the central processing unit; and further includes a fire extinguisher assembly being adapted to be securely disposed in a vehicle and being connected to the central processing unit.

6 Claims, 3 Drawing Sheets

VEHICLE FIRE EXTINGUISHER SYSTEM

BACKGROUND OF THE INVENTION

1. Field of the Invention

The present invention relates to a fire extinguisher for vehicles and more particularly pertains to a new vehicle fire extinguisher system for extinguishing a fire in event of a crash or another adverse vehicle mishap.

2. Description of the Prior Art

The use of a fire extinguisher for vehicles is known in the prior art. More specifically, a fire extinguisher for vehicles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,633,967; 3,876,011; 4,383,579; 4,262,749; 5,762,145; and U.S. Pat. No. Des. 372,560.

While these devices fulfill their respective, particular objectives and requirements, the aforementioned patents do not disclose a new vehicle fire extinguisher system. The inventive device includes a central processing unit being adapted to be securely mounted in a vehicle including airplanes; and also includes a plurality of heat and impact sensors adapted to be disposed about a vehicle and being connected to the central processing unit; and further includes a fire extinguisher assembly being adapted to be securely disposed in a vehicle and being connected to the central processing unit.

In these respects, the vehicle fire extinguisher system according to the present invention substantially departs from the conventional concepts and designs of the prior art, and in so doing provides an apparatus primarily developed for the purpose of extinguishing a fire in event of a crash or another adverse vehicle mishap.

SUMMARY OF THE INVENTION

In view of the foregoing disadvantages inherent in the known types of fire extinguisher for vehicles now present in the prior art, the present invention provides a new vehicle fire extinguisher system construction wherein the same can be utilized for extinguishing a fire in event of a crash or another adverse vehicle mishap.

The general purpose of the present invention, which will be described subsequently in greater detail, is to provide a new vehicle fire extinguisher system which has many of the advantages of the fire extinguisher for vehicles mentioned heretofore and many novel features that result in a new vehicle fire extinguisher system which is not anticipated, rendered obvious, suggested, or even implied by any of the prior art fire extinguisher for vehicles, either alone or in any combination thereof.

To attain this, the present invention generally comprises a central processing unit being adapted to be securely mounted in a vehicle including airplanes; and also includes a plurality of heat and impact sensors adapted to be disposed about a vehicle and being connected to the central processing unit; and further includes a fire extinguisher assembly being adapted to be securely disposed in a vehicle and being connected to the central processing unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicle fire extinguisher system which has many of the advantages of the fire extinguisher for vehicles mentioned heretofore and many novel features that result in a new vehicle fire extinguisher system which is not anticipated, rendered obvious, suggested, or even implied by any of the prior art fire extinguisher for vehicles, either alone or in any combination thereof.

It is another object of the present invention to provide a new vehicle fire extinguisher system which may be easily and efficiently manufactured and marketed.

It is a further object of the present invention to provide a new vehicle fire extinguisher system which is of a durable and reliable construction.

An even further object of the present invention is to provide a new vehicle fire extinguisher system which is susceptible of a low cost of manufacture with regard to both materials and labor, and which accordingly is then susceptible of low prices of sale to the consuming public, thereby making such vehicle fire extinguisher system economically available to the buying public.

Still yet another object of the present invention is to provide a new vehicle fire extinguisher system which provides in the apparatuses and methods of the prior art some of the advantages thereof, while simultaneously overcoming some of the disadvantages normally associated therewith.

Still another object of the present invention is to provide a new vehicle fire extinguisher system for extinguishing a fire in event of a crash or another adverse vehicle mishap.

Yet another object of the present invention is to provide a new vehicle fire extinguisher system which includes a central processing unit being adapted to be securely mounted in a vehicle including airplanes; and also includes a plurality of heat and impact sensors adapted to be disposed about a vehicle and being connected to the central processing unit; and further includes a fire extinguisher assembly being adapted to be securely disposed in a vehicle and being connected to the central processing unit.

Still yet another object of the present invention is to provide a new vehicle fire extinguisher system that effectively extinguishes a fire to prevent the vehicle from exploding.

Even still another object of the present invention is to provide a new vehicle fire extinguisher system that prevents fires caused by any possible mishap such as crashes and electrical fires.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
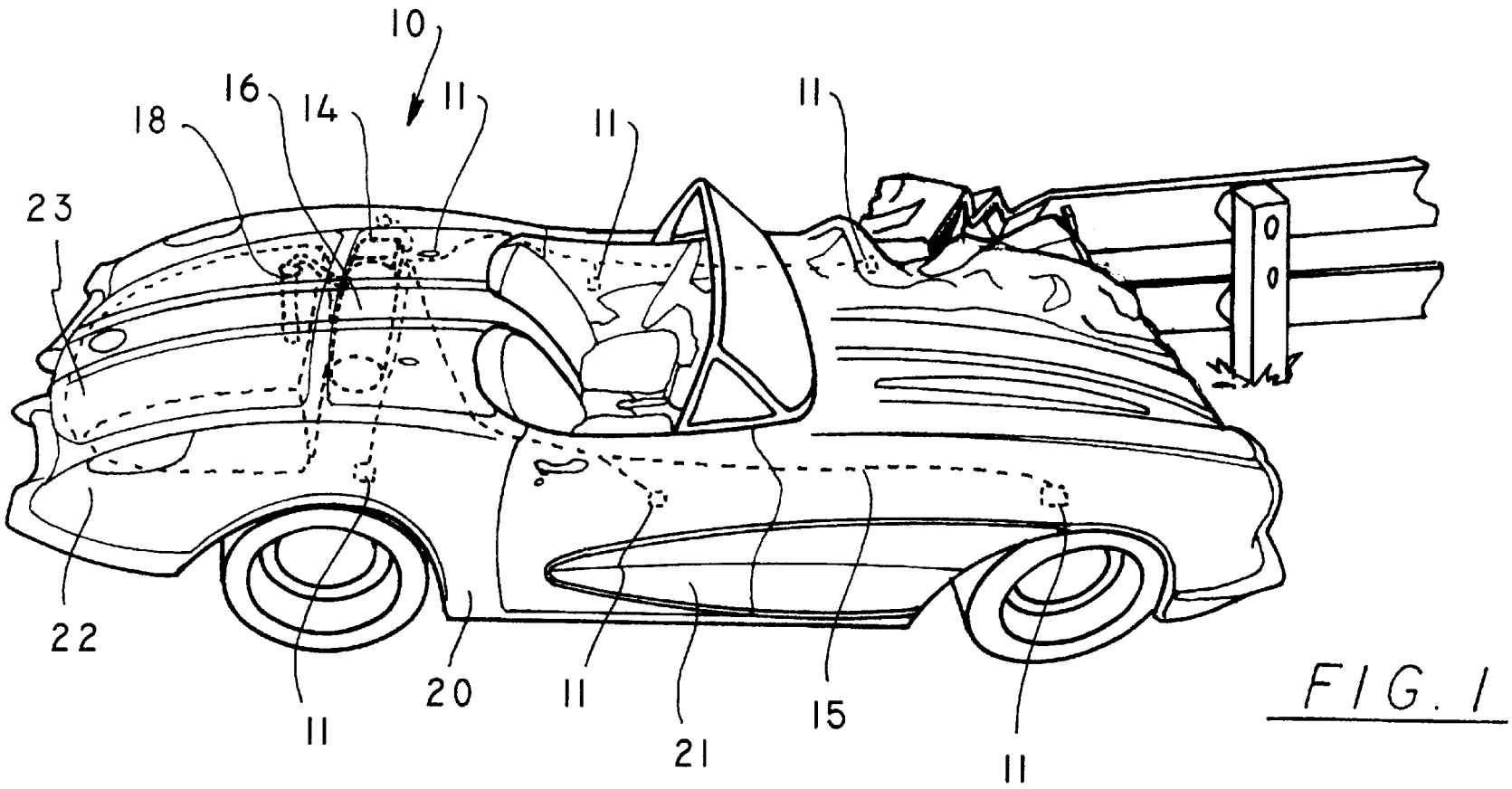
FIG. 1 is a perspective view of a new vehicle fire extinguisher system according to the present invention and shown in an automobile.
Figure 2:
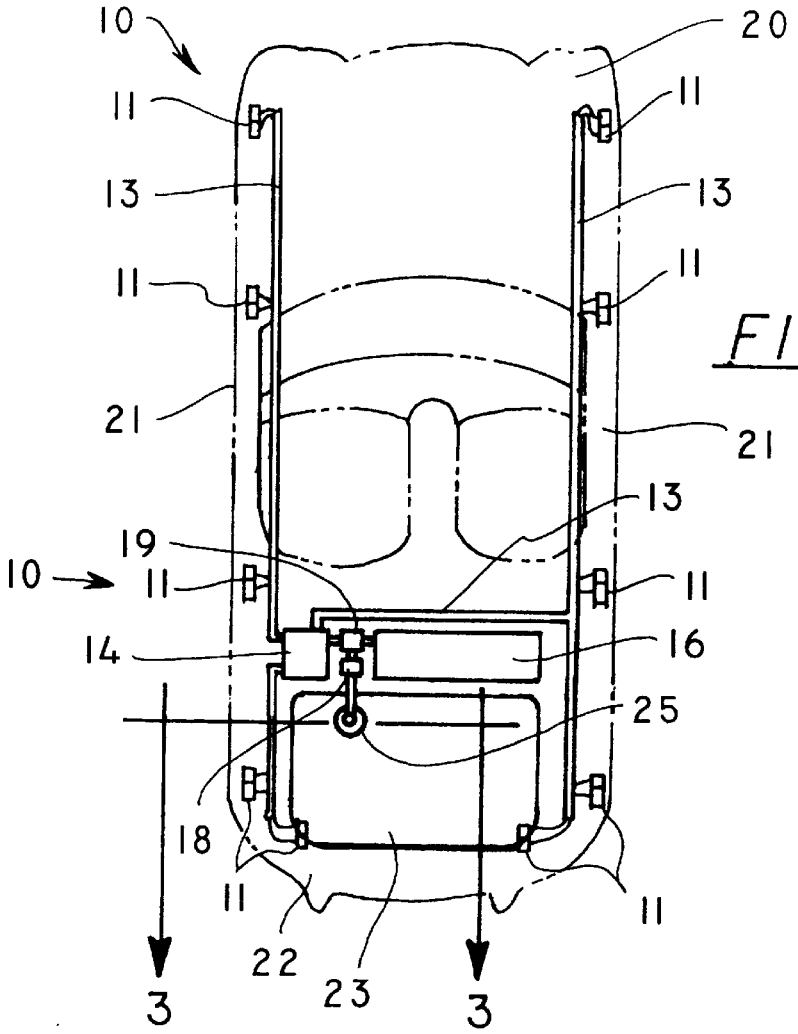
FIG. 2 is a top plan view of the present invention shown in an automobile.
Figure 3:
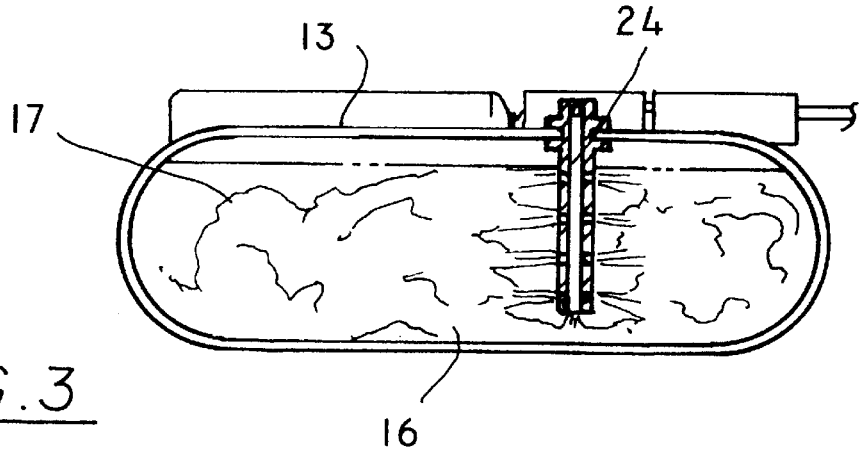
FIG. 3 is a cross-sectional view of the container of the present invention showing the mixing member, in particular.
Figure 4:
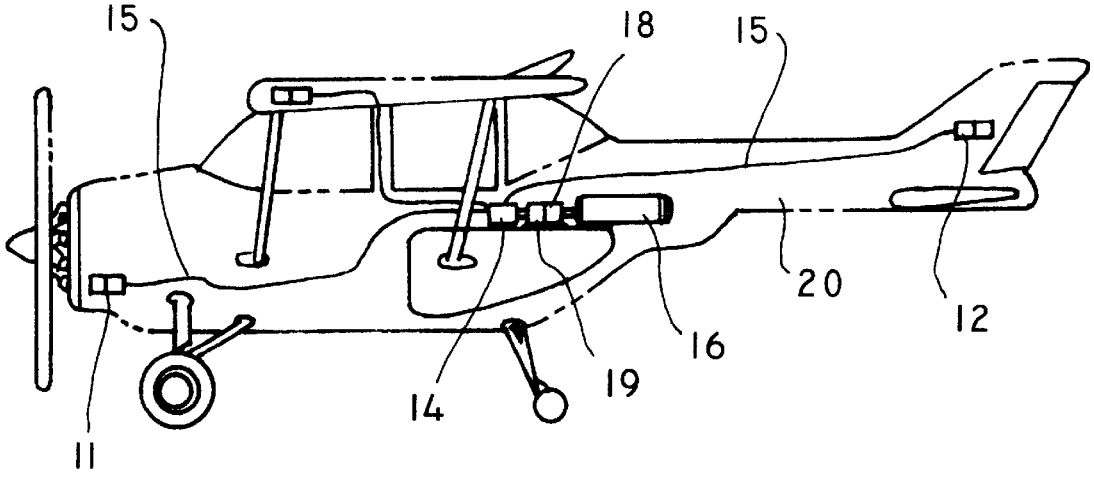
FIG. 4 is a side elevational view of the present invention shown in an airplane.

With reference now to the drawings, and in particular to FIGS. 1 through 4 thereof, a new vehicle fire extinguisher system embodying the principles and concepts of the present invention and generally designated by the reference numeral 10 will be described.

As best illustrated in FIGS. 1 through 4, the vehicle fire extinguisher system 10 generally comprises a central processing unit 14 being adapted to be securely and conventionally mounted in a vehicle 20 including airplanes. A plurality of heat and impact sensors 11, 12 are adapted to be disposed about a vehicle 20 and are conventionally connected with wires 15 to the central processing unit 14 with the plurality of heat and impact sensors 11, 12 including side heat and impact sensors 11 which are adapted to be disposed in side panels 21 of a body of the vehicle 20, and also including rear heat and impact sensors 12 which are adapted to be disposed about a gas tank 23 of the vehicle 20.

A fire extinguisher assembly is adapted to be securely and conventionally disposed in a vehicle 20 and is connected to the central processing unit 14 with wires 15. The fire extinguisher assembly includes a plurality of conduits 13 including tubular members having openings therein and being adapted to be disposed about the vehicle 20 at locations of the heat and impact sensors 11, 12, and also includes a container 16 being adapted to be securely and conventionally disposed in the vehicle 20, and further includes fire extinguishing material 17 disposed in the container 16, and also includes a valve member 19 conventionally connected to the container 16 for controlling dispensing of the fire extinguishing material 17 from the container 16, and further includes a pump 18 which includes a motor 25 and which is conventionally connected to the valve member 19 and to the conduits 13 for moving the fire extinguishing material 17 from the container 16 through the openings in the conduits 13, and also includes a mixing member 24 movably and conventionally disposed in the container 16 and being conventionally connected to the pump 18 for mixing the fire extinguishing material 17 contained in the container 16. The central processing unit 14 is adapted to receive signals from the heat and impact sensors 11, 12 and to open the valve member 19 to the container 16 and to energize the pump 18 for dispensing the fire extinguishing material 17 to the conduits 13 of where the heat and impact sensors 11, 12 were activated by heat or by impact. The fire extinguishing material 17 is stored in the container 16 under high pressure.

In use, the heat and impact sensors 11, 12 are activated by any number of vehicle mishaps including crashes and electrical fires and send a signal to the central processing unit 14 which opens the valve member 19 and energizes the pump 18 to dispense the conventional fire extinguishing material 17 from the container 16 to the conduits 13 and through the opening therein to the affected areas of where the heat and impact sensors 11, 12 were set off to extinguish fires before the vehicle 20 blows up.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A vehicle fire extinguisher system comprising, in combination:

a vehicle;

a central processing unit being adapted to be securely mounted within said vehicle;

a plurality of heat and impact sensors adapted to be disposed about said vehicle and being connected to said central processing unit;

a fire extinguisher assembly being adapted to be securely disposed in said vehicle and being connected to said central processing unit; and a pump connected to said valve member and to said conduits for moving said fire extinguishing material from said container through said openings in said conduits, and also includes a mixing member movably disposed in said container and being connected to said pump for mixing said fire extinguishing material contained in said container.

2. A vehicle fire extinguisher system as described in claim 1, wherein said plurality of heat and impact sensors include side heat and impact sensors which are adapted to be disposed in side panels of a body of the vehicle, and also include rear heat and impact sensors which are adapted to be disposed about a gas tank of the vehicle.

3. A vehicle fire extinguisher system as described in claim 2, wherein said fire extinguisher assembly includes a plurality of conduits having openings therein and being adapted to be disposed about the vehicle at locations of said heat and impact sensors, and also includes a container being adapted to be securely disposed in the vehicle, and further includes fire extinguishing material disposed in said container, and also includes a valve member connected to said container for controlling dispensing of said fire extinguishing material from said container.

4. A vehicle fire extinguisher system as described in claim 3, wherein said central processing unit is adapted to receive signals from said heat and impact sensors and to open said valve member to said container and to energize said pump for dispensing said fire extinguishing material to said conduits of where said heat and impact sensors were activated by heat or by impact.

5. A vehicle fire extinguisher system as described in claim 4, wherein said fire extinguishing material is stored in said container under high pressure.

6. A vehicle fire extinguisher system comprising, in combination:

a vehicle;

a central processing unit being adapted to be securely mounted in said vehicle;

a plurality of heat and impact sensors adapted to be disposed about said vehicle and being connected to said central processing unit, said plurality of heat and impact sensors including side heat and impact sensors which are adapted to be disposed in side panels of a body of the vehicle, and also including rear heat and impact sensors which are adapted to be disposed about a gas tank of the vehicle; and a fire extinguisher assembly being adapted to be securely disposed in said vehicle and being connected to said central processing unit, said fire extinguisher assembly including a plurality of conduits having openings therein and being adapted to be disposed about the vehicle at locations of said heat and impact sensors, and also including a container being adapted to be securely disposed in the vehicle, and further including fire extinguishing material disposed in said container, and also including a valve member connected to said container for controlling dispensing of said fire extinguishing material from said container, and further including a pump connected to said valve member and to said conduits for moving said fire extinguishing material from said container through said openings in said conduits, and also including a mixing member movably disposed in said container and being connected to said pump for mixing said fire extinguishing material contained in said container, said central processing unit being adapted to receive signals from said heat and impact sensors and to open said valve member to said container and to energize said pump for dispensing said fire extinguishing material to said conduits of where said heat and impact sensors were activated by heat or by impact, said fire extinguishing substance being stored in said container under high pressure.

* * * * *